United States Patent [19]

Dorosh

[11] 4,192,205

[45] Mar. 11, 1980

[54] STUD EXTRACTOR

[76] Inventor: Michael Dorosh, Box 65, Boyle, Alberta, Canada

[21] Appl. No.: 907,407

[22] Filed: May 18, 1978

[30] Foreign Application Priority Data

Apr. 24, 1978 [CA] Canada ..... 301832

[51] Int. Cl.[2] ..... B25B 13/54

[52] U.S. Cl. ..... 81/53.2

[58] Field of Search ..... 81/53.2, 71, 72; 29/240; 279/2

[56] References Cited

U.S. PATENT DOCUMENTS 1,428,035 9/1922 Jarmolowsky ..... 81/72

1,492,466 4/1924 Jarmolowsky ..... 81/72

FOREIGN PATENT DOCUMENTS 957489 11/1974 Canada ..... 81/72

*Primary Examiner*—Gary L. Smith

*Assistant Examiner*—Roscoe V. Parker

*Attorney, Agent, or Firm*—Mason, Fenwick & Lawrence

[57] ABSTRACT

A torque transmitting device for insertion into a bore in a workpiece, the device being, for example, a stud extractor, has slots spaced around the periphery of a shaft and extending longitudinally of the shaft, each of the slots having a bottom surface inclined towards the periphery of the shaft, and a workpiece-engaging blade in each of the slots. Each blade is formed with an outer cutting edge for biting engagement with the wall of the bore and has, at one of its end, a radially outwardly extending projection. An annular blade retainer extends around the blades and the shaft and engages the projections for retaining the blades on the shaft, the retainer being displaceable along the shaft. A nut in threaded engagement with the shaft serves for longitudinally displacing the blades on rotation of the nut relative to the shaft.

2 Claims, 8 Drawing Figures

STUD EXTRACTOR

The present invention relates to a torque transmitting device for insertion into a bore in a workpiece when it is desired to be able to transmit a force to the workpiece.

More particularly, the present invention is applicable to stud extractors for removing studs, broken shafts or other threaded members from, for example, engine blocks, brake drums etc.

In my Canadian Pat. No. 957,489, issued Nov. 12, 1974, I have disclosed a torque transmitting device which comprises a shaft formed with longitudinal slots each holding a workpiece-engaging blade, with means for displacing the blades outwardly of the shaft, each of the blades being formed with an outer cutting edge for biting engagement with a workpiece so that torque can be applied to the workpiece by turning the shaft.

With this prior invention, it was possible to substantially reduce outwardly acting forces exerted on the workpiece, as compared with earlier devices, since the blade cutting edges facilitated gripping of the device in the workpiece.

The blades were retained in their slots by forming on the shaft, along each of the slots, a plurality of small tangs, which prevented removal of the blades from the slots.

However, such tangs can readily be damaged, or entirely broken away, when the device is in use, for example if the blades are strongly urged against the tangs when the device is not inserted into a workpiece, and are difficult to form.

It is accordingly an object of the present invention to provide a novel and improved torque transmitting device of the type having workpiece-engaging blades slidable in longitudinal slots in a shaft, in which the blades are securely retained in the shaft but can be readily extended therefrom without damaging the device.

According to the present invention, there is provided a torque transmitting device for insertion into a bore in a workpiece, comprising a shaft formed with a plurality of slots spaced around the periphery of the shaft and extending parallel to the longitudinal axis of the shaft, each of the slots having a bottom surface which is inclined towards the periphery of the shaft in a direction extending towards one end of the shaft, a workpiece-engaging blade in each of the slots, each of the workpiece engaging blades being formed with an outer cutting edge for biting engagement with the wall of the bore and having, at its end remote from said one end of the shaft, a radially outwardly extending projection, annular blade retaining means extending around the blades and the shaft and engaging the projections for retaining the blades on the shaft, the annular blade retaining means being displaceable along the shaft, and a nut in threaded engagement with the shaft for longitudinally displacing the blades on rotation of the nut relative to the shaft.

Preferably, the annular retainer is formed with at least one recess in its periphery, intermediate opposite axial ends of its inner periphery, for receiving the projections therein.

To facilitate assembly and dismantling of the device, the annular retainer may be formed in two separate annular portions which are releaseably secured together.

The invention will be more readily understood from the following description of a preferred embodiment thereof given, by way of example, with reference to the accompanying drawing, in which.

Figure 1:
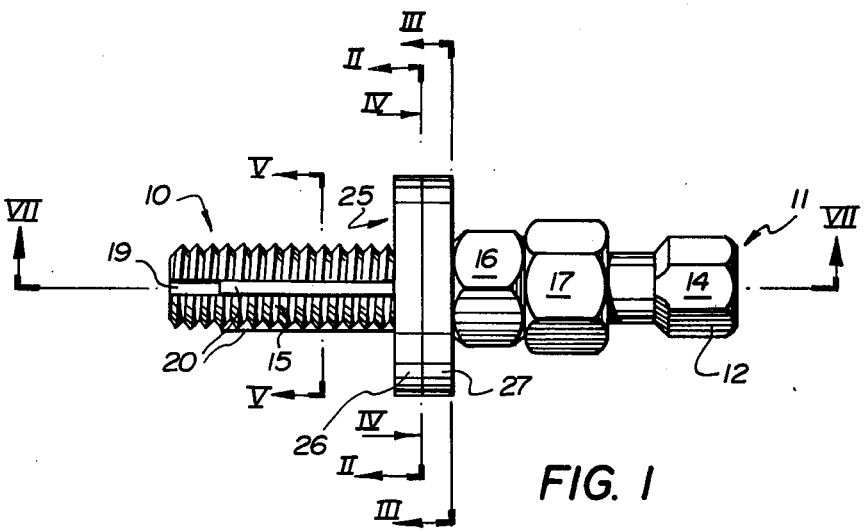
FIG. 1 shows a side view of a stud extractor embodying the present invention.

The stud extractor illustrated in the accompanying drawings has a shaft, indicated generally by reference numeral 10, which is formed at one end thereof with a head, indicated generally by reference numeral 11.

The head 11 has a cylindrical surface 12 which is interrupted by two flats 14 (see also FIG. 8), which enable engagement of the shaft head 14 with a wrench.

A major portion of the length of the shaft 10 is formed with a screw thread 15, which is in threaded engagement with two nuts 16 and 17.

The screw thread 15 is interrupted by three slots 19 which are equi-angularly spaced around the periphery of the shaft 10 and which are parallel to the longitudinal axis of the shaft 10.

Each of the shafts accommodates a workpiece-engaging blade 20, which is longitudinally slidable to and fro in its respective slot 19.

Figure 6:
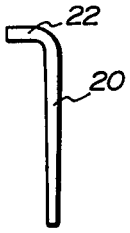
FIG. 6 shows a side view of one of the blades of the stud extractor of FIG. 1.
Figure 7:
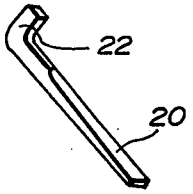
FIG. 7 shows a view in perspective of the blade of FIG. 6.

One of the blades is illustrated in FIGS. 6 and 7, from which it will be seen that this blade is bent, at one end thereof, to form a projection 22.

Figure 5:
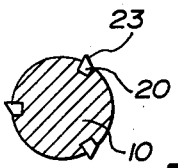
FIG. 5 shows a view taken in transverse cross-section through the shaft of the stud extractor of FIG. 1 along the line V—V.

As can also be seen from FIGS. 5 and 7, the blade has a trapezoidal cross-section, which fits snugly in its slot 19, and a cutting edge 23.

The blades 20 are retained in their slots 19 by an annular blade retainer, which is indicated generally by reference numeral 25, and which comprises two annular blade retainer halves 26 and 27.

Figure 2:
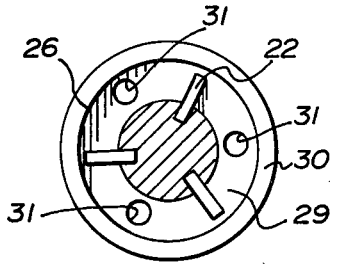
FIG. 2 shows a view taken in cross-section through the stud extractor of FIG. 1 along the line II—II.
Figure 3:
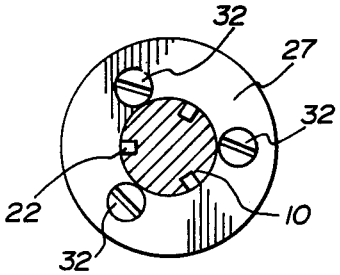
FIG. 3 shows a view taken in transverse cross-section through the stud extractor along the line III—III of FIG. 1.

Referring now to FIG. 2, it will be observed that the annular blade retainer half 26 is formed, at its side facing the annular blade retainer half 27, with an annular recess 29 which extends radially outwardly from the inner periphery of the annular blade retainer half 26 to an annular peripheral rim 30.

Figure 4:
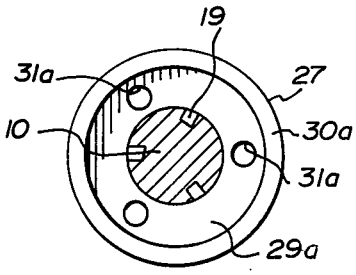
FIG. 4 shows a view taken in transverse cross-section through the stud extractor along the line IV—IV of FIG. 1.

As shown in FIG. 4, the annular blade retainer half 27 is formed with a corresponding annular recess **29*a* and an annular rim 30*a* at its side facing the annular blade retainer half 26**.

Three equi-angularly spaced openings 31 are formed in the annular blade retainer half 26 in alignment with three corresponding, equi-angularly spaced, but unthreaded holes **31*a* in the annular blade retainer half 27, and three screws 32 inserted into the holes 31*a*, from the right-hand side of the blade retainer 25, as viewed in FIG. 1, are in threaded engagement in the holes 31 for securing together the two blade retainer halves 26 and 27** in a readily releasable manner.

The projections 22 of the workpiece-engaging blades 20 extend radially outwardly of the shaft 10 into an annular space formed in the blade retainer 25 by the annular recesses 29 and 29*a*, so that the blades 20 are retained by the blade retainer 25 relative to the shaft 10.

The blades 20 are formed of a high tensile strength metal or alloy, for example tempered steel, so as to be wear resistant. However, if these blades 20 become worn or otherwise damaged, they are readily replaceable by unscrewing the screws 32 to release the annular blade retainer halves 26 and 27 from one another, so that the annular blade retainer half 26 can be displaced along the shaft 10 to the left, as viewed in FIG. 1, and removed from the shaft to allow replacement of the blades 20, following which the annular blade retainer half 26 is replaced and resecured relative to the annular blade retainer half 27.

When the device is in use, it is firstly inserted into a bore in a workpiece upon which it is desired to exert a torque and, if required, may be tapped into the bore by impacts of a hammer against the shaft head 11.

With the nut 17 released, the nut 16 is then rotated around the shaft so as to displace the annular blade retainer 25, and therewith the three blades 20, longitudinally of the shaft 10 towards the end of the shaft 10 opposite from the shaft head 11.

Figure 8:
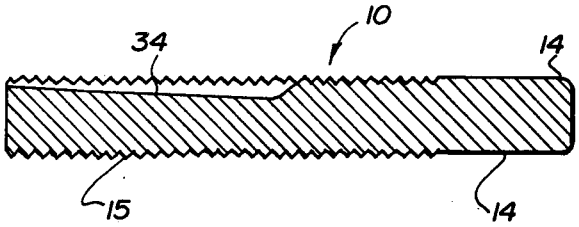
FIG. 8 shows a longitudinal cross-section through the shaft of FIG. 1 taken along the line VIII—VIII.

Since each of the longitudinal slots 19 has a bottom surface 34 which, as illustrated in FIG. 8, is inclined towards the periphery of the shaft 10 and towards the end of the latter remote from the shaft head 11, the axial displacement of the blades 20 towards this end of the shaft will cause them to be displaced radially outwardly of the shaft 10 by a wedging action of the slot bottoms 34, so that the cutting edges 23 of the workpiece-engaging blades 20 will bite into the wall of the bore.

The nut 17 can then be tightened against the nut 16 and rotated by means of a wrench to apply a torque to the workpiece.

If the shaft 10 should become broken within the workpiece, the blades 20 are retained by the blade retainer halves 26 and 27 and can be withdrawn by taping the shaft 10 further into the workpiece to loosen the blades. The blade retainer halves 26 and 27 thus not only securely retain the blades relative to the shaft 10 when the tool is not in use, but also retain the blades from further penetration into the workpiece during the extraction of the tool from the workpiece.

I claim:

1. A torque transmitting device for insertion into a bore in a workpiece, comprising a shaft formed with a plurality of slots spaced around the periphery of said shaft and extending parallel to the longitudinal axis of said shaft;

each of said slots having a bottom surface which is inclined towards the periphery of said shaft in a direction extending towards one end of said shaft;

a workpiece-engaging blade in each of said slots;

each of said workpiece-engaging blades being formed with an outer cutting edge for biting engagement with the wall of the bore and having, at its end remote from said one end of said shaft, a radially outwardly extending projection;

annular blade retaining means extending around said blades and said shaft;

said annular blade retaining means being formed with at least one recess in its inner periphery intermediate opposite axial ends of its inner periphery for receiving and engaging said projections;

said annular blade retaining means comprising two separate annular portions and means for releasably securing said two annular portions together;

said two annular portions defining said recess therebetween; and said annular blade retaining means being displaceable along said shaft; and a nut in threaded engagement with said shaft at the side of said annular blade retaining means remote from said one end of said shaft for longitudinally displacing said annular blade retaining means and therewith said blades on rotation of said nut relative to said shaft.

2. A torque transmitting device as claimed in claim 1, wherein the other end of said shaft is formed with a head having flats for engagement with a wrench.

* * * * *